US005780169A

United States Patent [19]

Hiraoka et al.

[11] Patent Number: 5,780,169

[45] Date of Patent: Jul. 14, 1998

[54] GOLF BALL

[75] Inventors: Hidenori Hiraoka; Kuniyasu Horiuchi, both of Kobe; Yoshikazu Yabuki, Akashi; Yoshimasa Koizumi; Kiyoto Maruoka, both of Kobe, all of Japan

[73] Assignee: Sumitomo Rubber Industries, Ltd., Hyogo-ken, Japan

[21] Appl. No.: 650,033

[22] Filed: May 17, 1996

Related U.S. Application Data

[63] Continuation of Ser. No. 158,792, Dec. 1, 1993, abandoned.

[30] Foreign Application Priority Data

Dec. 1, 1992 [JP] Japan ..... 4-349862

[51] Int. Cl.[6] ..... A63B 37/10

[52] U.S. Cl. ..... 428/517; 273/317.2; 428/411.1

[58] Field of Search ..... 273/62, 317.2; 428/411, 411.1, 517

[56] References Cited

U.S. PATENT DOCUMENTS

| | | | |
|---|---|---|---|
| 4,085,937 | 4/1978 | Schenk | 273/219 |
| 4,836,552 | 6/1989 | Puckett et al. | 273/318 |
| 4,863,167 | 9/1989 | Matsuki et al. | 273/62 |
| 5,026,067 | 6/1991 | Gentiluomo | 273/218 |

FOREIGN PATENT DOCUMENTS

| | | |
|---|---|---|
| 0154735 | 9/1985 | European Pat. Off. . |
| 2167309 | 5/1986 | United Kingdom . |
| 2245580 | 1/1992 | United Kingdom . |

*Primary Examiner*—Cecilia J. Tsang
*Assistant Examiner*—Patrick R. Delaney
*Attorney, Agent, or Firm*—Birch, Stewart, Kolasch & Birch, LLP

[57] ABSTRACT

Disclosed is a golf ball comprising a core 1 composed of a center 1*a* and an outer shell 1*b*, and a cover 2 covering said core 1, wherein a specific gravity of said center 1*a* is 0.2 to 1. The golf ball has excellent flying distance and satisfies other performances of golf balls.

10 Claims, 1 Drawing Sheet

GOLF BALL

This application is a continuation, of application Ser. No. 08/158,792 filed on Dec. 1, 1993, now abandoned.

FIELD OF THE INVENTION

Figure 1:
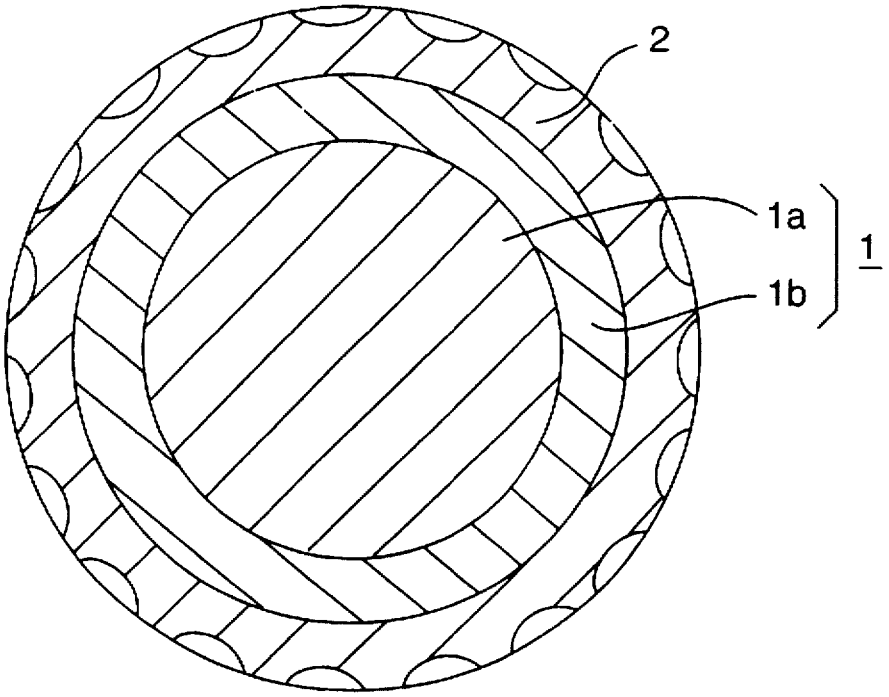
FIG. 1 is a sectional view which schematically shows an example of the golf ball of the present invention.

The present invention relates to a golf ball having three layer construction which is obtained by covering a core composed of a center and an outer shell with a cover.

BACKGROUND OF THE INVENTION

Conventionally, the main type of three-layered golf ball has been so-called thread wound golf balls which are obtained by winding rubber thread around a center in which solid or liquid is filled and then covering the rubber-thread wound center with a cover mainly made of natural or synthetic resin (for instance, Japanese Kokai Publication Sho 60(1985)-168471).

However, the thread wound golf balls are inferior to two-piece solid golf balls with two-layer construction obtained by covering a solid core with a cover mainly made of ionomer resin, in respect of flying distance. The two-piece solid golf ball, however, is not fully satisfactory to requirements of golf balls.

SUMMARY OF THE INVENTION

Thus the objective of the present invention is to solve the aforesaid problems and provide golf balls with excellent flying distance and satisfactory other performances.

The present invention achieves the aforesaid objective by constituting the golf ball in such way that the core is made into two-layer construction, namely, a center and an outer shell, and a specific gravity of the center is made to be 0.2 to 1 and the core of two layer construction is covered with the cover mainly made of ionomer resin.

In the present invention, the central part of the golf ball is made lighter by reducing the specific gravity of the center to 0.2 to 1 and thereby increasing the inertia moment of golf ball so that the ball spin is less and the ball flying angle is higher than the conventional two-piece golf balls.

DETAILED DESCRIPTION OF THE INVENTION

The construction of the golf ball of the present invention is described in reference to the drawing. FIG. 1 is a sectional view which shows schematically an example of the golf ball of the present invention. In the drawing, 1 is the core, which comprises the center 1*a* and the outer shell 1*b*, wherein the specific gravity of the center 1*a* is 0.2 to 1. The number 2 is the cover which covers the core 1 having two-layer construction, the cover being mainly made of ionomer resin.

The center is composed of vulcanized rubber containing light-weight filler, resin containing light-weight filler, foamed rubber, foamed resin, etc.

For instance, the rubber composition used for obtaining the vulcanized rubber for construction of the center preferably contains a butadiene rubber as base rubber and a metal salt of α,β-ethylenic unsaturated carboxylic acid as vulcanization agent. Preferred metal salts of (α,β-ethylenic unsaturated carboxylic acids are zinc acrylate or zinc methacrylate. The vulcanization agent may be formed when mixing the rubber composition obtained by reacting an (α,β-ethylenic unsaturated carboxylic acid with metal oxide (e.g. zinc oxide) during kneading for preparation of the rubber composition.

Another rubber, such as natural rubber, isoprene rubber, styrene-butadiene rubber etc., may be mixed with the butadiene rubber.

Since the specific gravity of the center must be 0.2 to 1, it is necessary to use a filler with light weight and for such light-weight filler, it is preferred to use hollow plastic particles or hollow glass particles.

The vulcanization initiator can be an organic peroxide and the preferred example thereof may be dicumyl peroxide. Alternatively, vulcanization may be done by ordinary sulfur vulcanization or by unsaturated ester monomer.

The preferred example of the rubber composition to be used for preparation of the center may comprise 100 wt parts of a rubber component and 2 to 15 wt parts of the metal slat of α,β-ethylenic unsaturated carboxylic acid (or alternatively, a combination of 2 to 15 wt parts of α,β-ethylenic unsaturated carboxylic acid and 2 to 15 wt parts of metal oxide), 3 to 200 wt parts of the light weight filler and 0.5 to 5 wt parts of the vulcanization initiator.

When the center is composed of a foamed resin, the resin used may be a thermoplastic resin such as ionomer resin, polyethylene, polystyrene or a thermo-setting resin such as phenolic resin.

In the present invention, the reason why the specific gravity of the center is required to be 0.2 to 1 is because when the specific gravity of the center is smaller than 0.2, molding of the center is difficult while when the specific gravity of the center is larger than 1, the effect of the higher inertia moment for improvement of flying distance is less.

The weight of the outer shell is preferred to be set in correlation to the weight of the center, so that the weight of the entire core combining the center and the outer shell shall be within 32.0 to 39.0 g.

The outer shell is composed from vulcanized rubber. The rubber composition for the manufacture of the outer shell contains butadiene rubber as base rubber, similar to the center. The rubber composition containing this base rubber, vulcanization agent, vulcanization initiator etc. may be the same as the those used for the center.

However, in order to adjust the weight of the entire core, it is preferred to use a filler with a high specific gravity for the outer shell and such filler may be for example, tungsten, tungsten carbide, barium sulfate, zinc oxide, etc. but it is not limited thereto. It is also possible to use a vulcanization agent different from the one used for the center.

The preferred example of compounding ratio of the composition for the manufacture of the outer shell may comprise 10 wt parts of a rubber component, 10 to 50 wt parts of the metallic salt of α,β-ethylenic unsaturated carboxylic acid (or alternatively a combination of 10 to 50 wt parts of (α,β-ethylenic unsaturated carboxylic acid and 10 to 50 wt parts of metal oxide), 3 to 200 wt parts of the filler with high specific gravity and 0.5 to 1.5 wt parts of the vulcanization initiator.

Since it is necessary to adjust the specific weight of the outer shell in relation to the specific gravity of the center so that the weight of the entire core shall be within the specified range, the range of variation of the compounding amount of the filler may be large, as aforesaid.

The diameter of the center and diameter of the outer shell (outer diameter of the core) etc. are not specifically restricted but the diameter of the center is preferred to be about 10 to 38 mm and the diameter of the outer shell is preferred to be around 37 to 40 mm though it depends on the diameter of the center.

When the center is composed of vulcanized rubber, it is usually practiced to place the rubber composition for the manufacture of center in a metal mold and mold it by press under vulcanization while the vulcanization condition at press-molding is preferred to be 145° to 180° C. and 15 to 50 minutes. However, the temperature at vulcanization molding is not necessarily constant and the temperature may be changed through more than two stages.

On the other hand when the center is composed of a foamed resin, molding is conducted by injection-molding or press-molding. In the case of injection-molding, it is preferred that the heating temperature in the metal mold is 240° to 250° C. and heating time is between 2 to 10 min. and cooling time is 1 to 5 min. In the case of press-molding, the preferred temperature is 240° to 250° C., time in the metal mold is 5 to 30 min. and cooling time is 1 to 10 min.

The outer shell is molded usually by applying a sheet of the desired thickness of the rubber composition used for preparation of the outer shell at the surface of the molded center and press-molding it.

However, the method is not restricted thereto but such method may be employed that the half shell is molded and two shells are joined together or they may be molded by injection molding.

In the molding of the aforesaid center or outer shell, vulcanization is not necessarily required to be crosslinking through sulfur and therefore it may be more appropriate to express it generally as "crosslinking" but in this specification, following the customary practice, it is expressed as vulcanization.

The cover is formed by covering the core with a cover material mainly composed of ionomer resin and, upon necessity, with an appropriate amount of inorganic oxide such as titanium dioxide ($TiO_2$). It is preferred that a specific gravity of the cover is within the range of 0.9–2.0.

To execute the covering, usually injection molding method is employed but it is not limited thereto. The ionomer resin may be mix with an appropriate amount of another resin (e.g. polyethylene, polyamide etc.),if necessary.

The thickness of the cover is not specifically restricted but it is usually 1.0 to 2.7 mm. At the time of molding of the cover, dimples may be formed as desired and after molding or at the molding of the cover, paint or marking is applied as desired.

EXAMPLES

The present invention is described more concretely in reference to the Examples. However, the present invention is not limited to these Examples.

Examples 1 to 2 and Comparative Example 1

Ingredients with the compounding ratio as shown in Table 1 were kneaded to prepare a rubber composition for the preparation of the center of Example 1 and Comparative Example 1, the kneaded mixture was made into a sheet, placed in a metal mold and molded under vulcanization at 150° C. for 30 min. in the case of Example 1 and at 155° C. for 25 min. in the case of Comparative Example 1, to prepare the center having a diameter of 31mm.

In the case of Example 2, the mixture of ionomer resin and foaming agent with composition as shown in Table 1 was injection-molded for 10 min. at 240° C. to prepare the center having a diameter of 31 mm. Table 1 shows the specific gravity of the center obtained in Examples 1 to 2 and Comparative Example 1. The compounding amounts of the materials of Table 1 are indicated by weight parts.

TABLE 1

| | Center | | |
|---|---|---|---|
| | Example 1 | Example 2 | Comp. Ex. 1 |
| Butadiene rubber *1 | 100 | — | 100 |
| Zinc oxide | 5 | — | 18.5 |
| Zinc acrylate | 5 | — | 23 |
| Hollow glass particles *2 | 70 | — | — |
| Dicumyl peroxide | 2 | — | 1.4 |
| Ionomer resin *3 | — | 100 | — |
| Foaming agent *4 (master batch) | — | 55 | — |
| Molding condition (°C.-min) | 150-30 | 240-10 | 155-25 |
| Specific gravity (23° C.) | 0.79 | 0.28 | 1.14 |
| Outer diameter (mm) | 31 | 31 | 31 |

(Note)
*1: Butadiene rubber with cis content of more than 90%.
*2: Glass bubbles, S60/10000 (tradename), manufactured by Sumitomo 3M Co.
*3: Himilan No. 1705 (tradename), manufactured by Mitsui DuPont Polychemical Co.
*4: Polystyrene I0600HL (tradename), manufactured by Eiwa Kasei Co., Ltd.

Next the rubber composition for the manufacture of outer shell with composition as shown in Table 2 was prepared. The compounding amounts of the materials in Table 2 are also by weight parts.

TABLE 2

| | Outer Shell | | |
|---|---|---|---|
| | Example 1 | Example 2 | Comp. Ex. 1 |
| Butadiene rubber | 100 | 100 | 100 |
| Zinc oxide | 41.4 | 135 | 18.5 |
| Zinc acrylate | 38 | 38 | 25 |
| Dicumyl peroxide | 1.2 | 1.2 | 1.5 |

The rubber composition for the manufacture of the outer shell was made into a sheet, applied around the center of Examples 1 to 2 and Comparative Examples 1 and core was made by press-vulcanization under the molding conditions shown in Table 3.

Table 3 shows the diameter of the core (same as the diameter of the outer shell), the weight and the surface hardness of the core.

TABLE 3

| | Core | | |
|---|---|---|---|
| | Example 1 | Example 2 | Comp. Ex. 1 |
| Molding condition (°C.-min) | 150-30 | 150-30 | 150-30 |
| Diameter of core (mm) | 38.4 | 38.4 | 38.4 |
| Weight of core (g) | 34.5 | 34.6 | 34.6 |

Subsequently the cover material was prepared by adding and blending 2 wt parts of titanium oxide ($TiO_2$) into 100 wt parts of ionomer resin (a 50:50 mixture by weight of Himilan 1706 (tradename) and Himilan 1605 (tradename) manufactured by Mitsui DuPont Polychemical Co.) and each core was covered with the cover material by injection molding to prepare a golf ball having a diameter of 42.7 mm in outer diameter.

Table 4 indicates the results of measurement of weight, compression and flying distance of the obtained golf ball according to USGA method. The flying distance represents the measured values for the case when the ball is hit by the driver at the head speed of 45 m/sec. using a swing robot (it is expressed in Table 4 as (HS 45 m/s by W No. 1)) and for the case when the ball is hit by No. 5 ion at the head speed of 38 m/sec. using the swing robot (it is expressed in Table 4 as (HS 38 m/s by I No. 5)).

Table 4 also shows the results of investigation of the physical properties of the standard two-piece solid golf ball and yarn-wound golf ball. The aforesaid two-piece golf ball is a ball having a diameter of 42.7 mm obtained by vulcanization-molding of the rubber composition compressing 100 wt parts of butadiene rubber compounded with 30 wt parts of zinc acrylate, 20.5 wt parts of zinc oxide and 1.5 wt parts of dicumyl peroxide and covering thus obtained solid core with the ionomer resin-based cover same as aforesaid to make the outer diameter of the ball 42.7 mm, wherein the diameter of the solid core is 38.4 mm and the weight is 34.7 g.

A thread wound golf ball is the ball obtained by covering the core of the thread wound construction with the ionomer resin-based cover to make the diameter of the ball 42.7 mm, wherein the diameter of the aforesaid thread wound core is 38.8 g, and the weight is 35.3 mm.

TABLE 4

Physical properties of golf ball

| | Weight (g) | Compression | Flying distance (yard) (W#1 HS 45 m/s | Flying distance (yard) I#5 HS 38 m/s |
|---|---|---|---|---|
| Example 1 | 45.4 | 87 | 234 | 168 |
| Example 2 | 45.4 | 108 | 236 | 169 |
| Comp. Ex.1 | 45.6 | 108 | 224 | 163 |
| Two-piece solid golf ball | 45.5 | 104 | 229 | 166 |
| Thread wound golf ball | 45.3 | 92 | 226 | 163 |

The golf ball of Comparative Example 1 is the golf ball with 3-layered construction wherein the specific gravity of the center is made larger than 1 and similar to the specific gravity of the outer shell. As shown in Table 4, the golf balls of Examples 1 and 2 indicated the larger flying distance than the golf ball of Comp. Example 1 and flying distance was larger than those of two-piece solid golf balls or thread wound golf balls. In particular, the ball of Example 1 indicated a larger flying distance, although the compression is low being 87 (which means soft and the impact resistance at the time of hitting is less).

As described above, the present invention provides the golf ball with large flying distance by using the core of two-layer construction, namely, the center and the outer shell, setting the specific gravity of the center at 0.2 to 1 and covering the core with the cover made mainly of ionomer.

What is claimed is:

1. A golf ball comprising a core 1 composed of a center 1*a* and an outer shell 1*b*, and a cover 2 covering said core wherein said center has a specific gravity of 0.2 to 0.79 and a diameter of 10 to 38 mm, said core has a weight of 32.0 to 39.0 g and has a diameter of 37 to 40 mm, and said cover has a thickness of 1.0 to 2.7 mm.

2. The golf ball according to claim 1 wherein said center 1*a* is prepared from a rubber composition which comprises a rubber, a metal salt of α,β-ethylenic unsaturated carboxylic acid, a light weight filler and a vulcanization initiator.

3. The golf ball according to claim 2 wherein said rubber is butadiene rubber.

4. The golf ball according to claim 2 wherein said light weight filler is hollow resin particles or hollow glass particles.

5. The golf ball according to claim 1 wherein said center is made of foamed resin.

6. The golf ball according to claim 1 wherein said outer shell is prepared from a rubber composition which comprises a rubber, a metal salt of α,β-ethylenic unsaturated carboxylic acid, a heavy weight filler and a vulcanization initiator.

7. The golf ball according to claim 6 wherein said rubber is butadiene rubber.

8. The golf ball according to claim 6 wherein said heavy weight filler is selected from the group consisting of tungsten, tungsten carbide, barium sulfate and zinc oxide.

9. The golf ball according to claim 1 wherein said cover is made of ionomer resin.

10. The golf ball according to claim 1, wherein said golf ball is a large size golf ball.

* * * * *